US006139133A

United States Patent [19]

Ishikawa

[11] Patent Number: 6,139,133

[45] Date of Patent: Oct. 31, 2000

[54] INK JET HEAD FOR EJECTING INK BY EXERTING PRESSURE ON INK IN INK CHANNELS

[75] Inventor: Hiroyuki Ishikawa, Nisshin, Japan

[73] Assignee: Brother Kogyo Kabushiki Kaisha, Nagoya, Japan

[21] Appl. No.: 09/048,220

[22] Filed: Mar. 26, 1998

[30] Foreign Application Priority Data

Mar. 31, 1997 [JP] Japan ..... 9-080154
Mar. 31, 1997 [JP] Japan ..... 9-080155

[51] Int. Cl.[7] ..... B41J 2/045; B41J 2/19

[52] U.S. Cl. ..... 347/71; 347/92

[58] Field of Search ..... 347/68, 71, 92

[56] References Cited

U.S. PATENT DOCUMENTS

| | | | |
|---|---|---|---|
| 4,312,010 | 1/1982 | Doring | 347/92 |
| 4,518,974 | 5/1985 | Isayama | 347/92 |
| 4,609,925 | 9/1986 | Nozu et al. | 347/92 X |
| 5,311,219 | 5/1994 | Ochiai et al. | 347/68 |
| 5,410,341 | 4/1995 | Sugahara et al. | 347/69 |
| 5,477,247 | 12/1995 | Kanegae | 347/20 |
| 5,502,472 | 3/1996 | Suzuki | 347/69 |
| 5,508,726 | 4/1996 | Sugahara | 347/68 |
| 5,594,482 | 1/1997 | Ohashi | 347/69 |
| 5,639,220 | 6/1997 | Hayakawa | 417/53 |
| 5,650,810 | 7/1997 | Muto | 347/71 |
| 5,657,063 | 8/1997 | Takahashi | 347/69 |
| 5,684,520 | 11/1997 | Morikoshi et al. | 347/68 X |
| 5,914,739 | 6/1999 | Zhang | 347/71 |

FOREIGN PATENT DOCUMENTS

| | | |
|---|---|---|
| 0 611 154 B1 | 8/1994 | European Pat. Off. . |
| 0 612 620 A2 | 8/1994 | European Pat. Off. . |
| 6-171096 | 6/1994 | Japan . |

*Primary Examiner*—William J. Royer
*Attorney, Agent, or Firm*—Oliff & Berridge, PLC

[57] ABSTRACT

An ink jet head has nozzles and ink channels connected to the nozzles. Side walls of the ink channel are formed from a piezoelectric material, and vary the capacity of the ink channel to eject ink through the nozzle. The ink channels each have a flat bottom surface at a site apart from the site of connection with the nozzle, and the ratio of H2, the depth of the ink channel at the site of connection with the nozzle, to H1, the depth of the ink channel having the flat bottom surface, i.e., the ratio H2/H1, is in the range of from 0.1 to 0.8. The ratio of the distance between the side walls of the ink channel to the height of the side wall of the ink channel at the site of connection with the nozzle is in the range of from 0.5 to 2.0. Thus, air bubbles building up in the ink channel can be easily discharged.

20 Claims, 9 Drawing Sheets

INK JET HEAD FOR EJECTING INK BY EXERTING PRESSURE ON INK IN INK CHANNELS

BACKGROUND OF THE INVENTION

1. Field of the Invention

The present invention relates to an ink jet head for ejecting ink through nozzles by exerting pressure on ink in ink channels formed in the ink jet head, and an ink jet recorder including the ink jet head.

2. Description of the Related Art

A communication device such as a facsimile machine or an information processor such as a personal computer usually has a recorder capable of recording data, comprising characters or graphics, onto a sheet of paper so as to store this data as visual information. The recorder adopts a printing system such as impact system, thermal system or ink jet system. In recent years, increased attention has been paid to an ink jet recorder using the ink jet system which is highly quiet and can print on various types of paper.

The above-described ink jet recorder has an ink jet head with numerous nozzles for ejecting ink droplets toward a sheet of paper so as to print characters or graphics thereon. Usually, the ink jet head, as illustrated in FIG. 14, is constituted such that a side wall 101 of an ink channel 105 communicating with a nozzle 100 is composed of a polarized piezoelectric material, and an electrode 102 is formed on the surface of the side wall. A drive electric field is applied to the side wall 101 via the electrode 102 to bend the side wall 101 and change the capacity of the ink channel 105. The resulting increase and decrease in the ink pressure cause the ink to be discharged (ejected) from and supplied to the ink channel 105.

If air bubbles 103 are present in the ink channel 105, a change in the capacity of the ink channel 105 is accommodated by the shrinkage and expansion of the air bubbles 103. Thus, the change in the capacity of the ink channel 105 is not fully reflected in an increase or decrease in the ink pressure, so that the ejection of an ink droplet may be insufficient. If the air bubbles 103 grow, they may obstruct the ink channel 105 or the nozzle 100, resulting in an ejection failure. Hence, when printing is started or ejection failure has been detected, it has been customary practice to carry out a suction treatment for locating suction means in close proximity to the outside of the nozzle 100 and sucking the air bubbles 103 together with ink in the ink channel 105.

However, a mere purge or suction treatment as described above tends to remove the air bubbles 103 insufficiently, if the air bubbles 103 exist at the corner of the nozzle plate 104 and the ink channel 105.

An attempt at the reliable removal of the air bubbles 103 would require that such a treatment be repeated many times.

There has been a proposal for a structure in which the bottom surface of the ink channel 105 is curved upward toward the nozzle 100 and the cross-sectional area of the ink channel is decreased to smooth the flow of ink and discharge the air bubbles 103 simultaneously with ink ejection through the nozzle (Japanese Unexamined Patent Publication No. 6-171096 corresponding to U.S. Pat. No. 5,650,810). This structure always results in a mere reduction of the cross-sectional area. It has remained unclear what cross-sectional shape and what dimensions will make the air bubbles 103 fully discharged.

SUMMARY OF THE INVENTION

It is an object of the invention, therefore, to provide an ink jet head and an ink jet recorder, each of which can fully remove air bubbles by a decreased number of suction treatments, with an ink channel appropriately configured and its cross section appropriately set.

A first aspect of the present invention provides an ink jet head comprising:

at least one nozzle formed at one end of the ink jet head; and at least one ink channel formed inside the ink jet head so as to connect with the nozzle; wherein the ink channel is formed so as to have a flat bottom surface at a portion apart from a portion connected to the nozzle and such that the ratio H2/H1 of the depth H2 of the ink channel at the portion connected to the nozzle to the depth H1 of the ink channel having the flat bottom surface is in the range of from 0.1 to 0.8.

In the ink jet head of the present invention, as noted above, the ratio H2/H1 (H2: the depth of the ink channel at the site of connection with the nozzle, H1: the depth of the ink channel having the flat bottom surface) is adjusted to fall within the range of from 0.1 to 0.8. Even if air bubbles are present in the ink channel, therefore, the air bubbles will be easily released outside through the nozzle together with ink. Such air bubbles can be reliably forced out through the nozzle by a suction procedure performed a small number of times.

The ink jet head may include a head body having a plurality of ink channels formed so as to pass through the inside of the head body, and a nozzle plate having a plurality of nozzles formed therein. The nozzle plate may be secured to the head body such that the nozzles are connected to one open end of the head body formed by the ink channels passing through the inside of the head body. It is particularly effective to apply the ink jet head with this structure to apply to the ink jet head of the present invention having the above H2/H1 ratio. With this structure, the depth H2 may be the depth of the ink channel at the one open end, while the depth H1 may be the depth of the ink channel at the other open end, and the depth of the ink channel may gradually decrease, beginning at an ink channel portion having the flat bottom surface and ending at the portion connected to the nozzle. To remove the air bubbles more effectively, the ratio of the depth H2 to the depth H1 of the ink channel, the H2/H1 ratio, is preferably in the range of from 0.2 to 0.6.

It is also effective for the present invention to be applied to an ink jet head of a structure in which the ink channel passes straight through the head body. The air bubbles can be released out of the nozzle more easily, by applying the ratio of the depth H2 to the depth H1 of the ink channel, the H2/H1 ratio, in accordance with the present invention to the head of a structure in which the ink channels pass straight through the head body.

A second aspect of the present invention provides an ink jet head comprising:

at least one nozzle formed at one end of the ink jet head; and at least one ink channel formed inside the ink jet head so as to connect with the nozzle; wherein the ratio of the distance between side walls of the ink channel to the height of the side walls of the ink channel at a portion connected to the nozzle is in the range of from 0.5 to 2.0.

According to the ink jet head of the present invention, air bubbles, if any, in the ink channel can be released outside through the nozzle along with ink, by adjusting the ratio of the distance between a pair of side walls defining the ink channel to the height of the side wall at the portion connected to the nozzle to fall within the above-mentioned range. Such air bubbles can be reliably forced out through the nozzle by a less frequent suction procedure.

In the ink jet head according to the second aspect of the invention, the cross-sectional area of the ink channel may be made larger at an inward site of the head body than at the site of connection with the nozzle, and the ink channel may be formed so as to have a flat bottom surface at a portion apart from the portion connected to the nozzle and such that the ratio of H2, the depth of the ink channel at the portion connected to the nozzle, to H1, the depth of the ink channel having the flat bottom surface, i.e., the ratio H2/H1, is in the range of from 0.1 to 0.8.

The ink jet head according to the first and second aspects of the invention may be a head of the type in which the side wall of the ink channel can be deformed so as to vary the cross-sectional area of the ink channel, whereby ink in the ink channel is ejected through the nozzle. In this case, the side wall of the ink channel may be composed of a piezoelectric material, and a drive electrode for deforming the piezoelectric material can be provided on the side wall.

A third aspect of the present invention provides an ink jet recorder comprising:

an ink jet head having at least one nozzle formed at one end of the ink jet head, and at least one ink channel formed inside the ink jet head so as to connect with the nozzle; and an ink supply device for supplying ink to the ink jet head; wherein the ink channel is formed so as to have a flat bottom surface at a portion apart from a portion connected to the nozzle and such that the ratio H2/H1 of the depth H2 of the ink channel at the portion connected to the nozzle to the depth H1 of the ink channel having the flat bottom surface is in the range of from 0.1 to 0.8.

A fourth aspect of the present invention provides an ink jet recorder comprising:

an ink jet head having at least one nozzle formed at one end of the ink jet head, and at least one ink channel formed inside the ink jet head so as to connect with the nozzle; and an ink supply device for supplying ink to the ink jet head; wherein the ratio of the distance between side walls of the ink channel to the height of the side walls of the ink channel at a portion connected to the nozzle is in the range of from 0.5 to 2.0.

According to these ink jet recorders, air bubbles penetrating the ink jet head are easily discharged by a suction procedure together with ink. Thus, high quality printing is ensured. These ink jet recorders may be any types of apparatuses utilizing ink jet recording such as an ink jet printer, ink jet facsimile and so on.

PREFERRED EMBODIMENTS OF THE INVENTION

Embodiments of the present invention will now be described with reference to the accompanying FIGS. 1 to 13.

Figure 1:
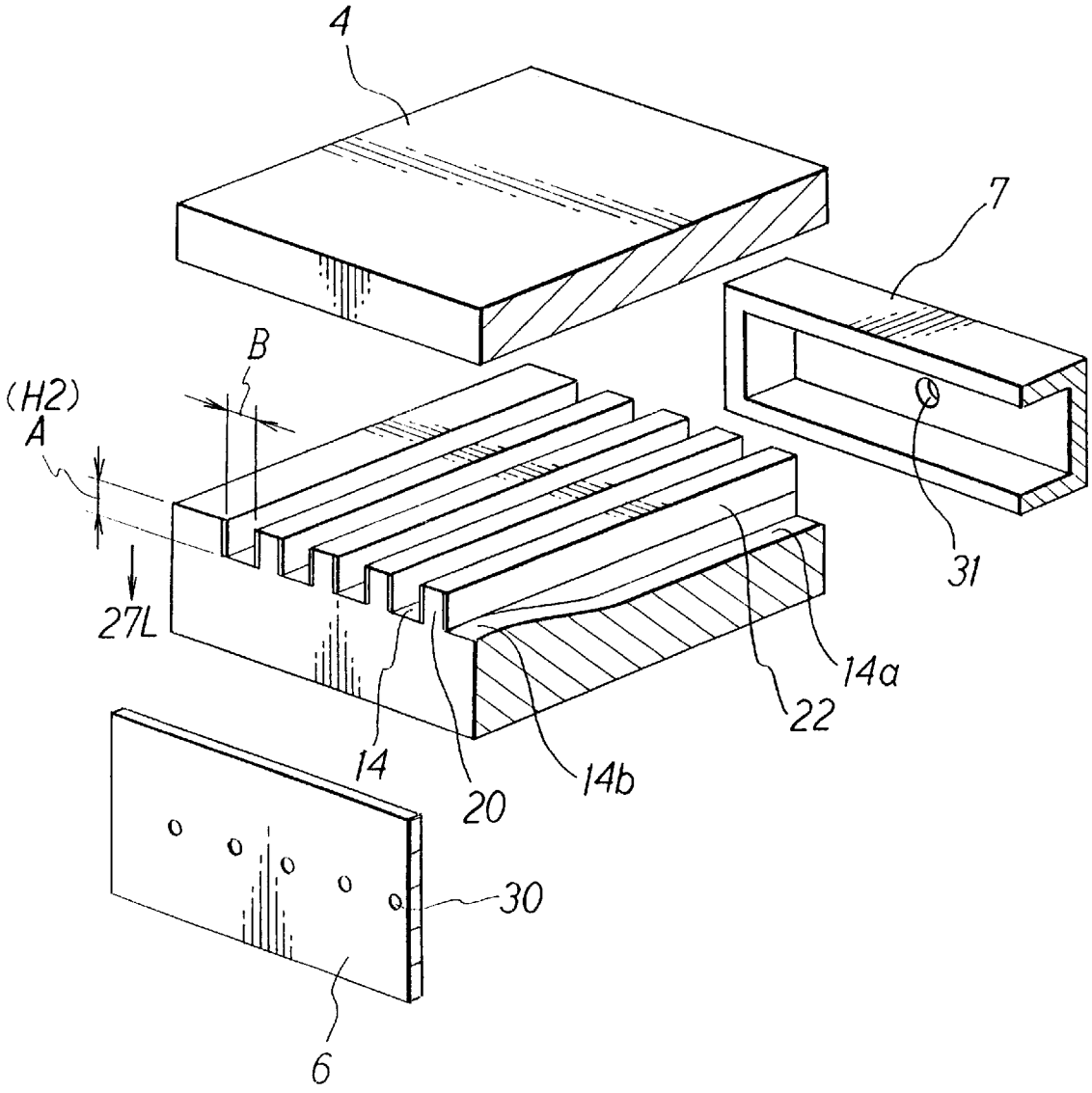
FIG. 1 is an exploded perspective view of an ink jet head according to the invention.

An ink jet head related to the embodiment of the invention, as illustrated in FIG. 1, has an actuator base plate 2, a plate member 4, a nozzle plate 6, and a manifold member 7. The actuator base plate 2 is formed of a piezoelectric material comprising a lead zirconate titanate (PZT) based ceramic material. On one surface of the actuator base plate, a plurality of ink grooves 14 formed by cutting with a diamond blade or the like are provided. As the piezoelectric material, a lead titanate (PT) based ceramic material may be used.

Figure 3:
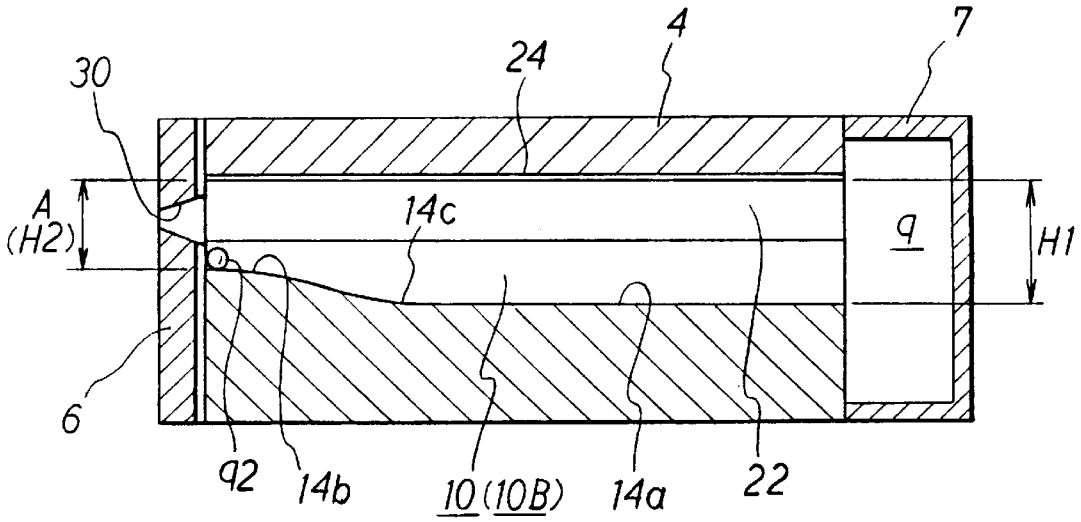
FIG. 3 is a longitudinal sectional view of the ink jet head shown in FIG. 1.

The ink groove 14, as shown in FIG. 3, has a flat bottom surface 14*a*. The bottom surface of the ink groove 14 is a flat portion 14*a* ranging from the rear end to an intermediate portion of the actuator base plate 2 and having a first depth H1. Then, the bottom surface rises with a decreasing depth from the intermediate portion toward the front end, drawing a gentle curve as in 14*c* and having a second depth H2 at the front end 14*b* of the actuator base plate 2. At the front end 14*b*, an ink channel 10 connects with a nozzle 30. The ink groove 14 is set to have the same width so as to make the distance between the side walls of the ink channel 10 (to be described later on) equal in the region from the front end to the rear end of the ink channel 10. The bottom surface of the ink groove 14 may be partly curved in a semicircular or concave form. The ink grooves 14 are arranged in parallel via side walls 20 polarized in the thickness direction 27L of the actuator base plate 2. In an upper part of the wall surface of the side wall 20, an electrode 22 is formed across both ends of the side wall 20 by vacuum deposition or plating so as to apply an electric field in a direction perpendicular to the direction 27L.

Figure 2:
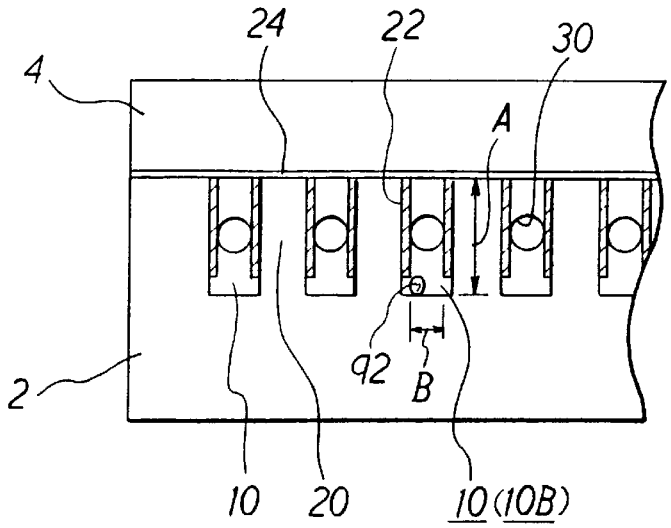
FIG. 2 is an explanatory cross sectional view showing ink channels of the ink jet head of the invention.

To one surface of the actuator base plate 2, a flat plate-shaped plate member 4 comprising a ceramic material or a resin material is bonded by the use of an epoxy adhesive. The plate member 4 is adhered to one surface of the side wall 20 in a liquid-tight condition via an adhesive layer 24, as shown in FIG. 2. By covering the groove opening of the ink groove 14, the plate member 4 defines an ink channel 10 which serves as an ink channel having a rectangular cross section. To one end (front end) of the actuator base plate 2 and plate member 4 that constitute the ink channel 10 in this manner, a nozzle plate 6 is bonded using the above-mentioned epoxy adhesive. The nozzle plate 6 is formed from a plastic material such as polyalkylene (e.g., polyethylene) terephthalate, polyimide, polyether imide, polyether ketone, polyether sulfone, polycarbonate or cellulose acetate.

In the nozzle plate 6, a nozzle 30 is formed in agreement with the ink channel 10 so as to communicate with each other. The nozzle 30 is in a nearly truncated conical shape. As shown in FIG. 3, its bore increases from the exit side toward the ink channel 10 side, reaching nearly the maximum diameter that can be set for the channel cross section of the ink channel 10, at the end face on the ink channel 10 side. That is, the nozzle 30 is formed with a diameter which defines a circle nearly inscribed in the channel cross section of the ink channel 10. In this case, the nozzle diameter may be slightly smaller than the diameter of the channel cross section in consideration of the positional deviation of the nozzle plate during its adhesion.

The channel cross section on the front end side of the ink channel 10 which the nozzle 30 communicates with is constituted as follows: The ratio of the distance B between the side walls 20 to the height A(H2) of the side wall at the site of bonding to the nozzle plate 6 is set at from about 0.5 to 2.0 so that air bubbles 92 can be fully removed through the nozzle 30 by a small number of suction treatments. The ink channel 10 is desirably constituted such that the ratio H2/H1 of the second depth H2 at the position of bonding to the nozzle plate 6 to the first depth H1 in a flat portion distant from the site of connection with the nozzle 30 is set at from 0.1 to 0.8. This is to ensure that the air bubbles 92 can be removed more effectively by generating a high ink pressure in the vicinity of the nozzle. In the embodiments of the present invention, the flat bottom surface of the ink channel refers to the rear portion 14*a* of the bottom surface of the ink channel as shown in FIG. 3. If there are differences in level in the bottom surface of the ink channel to create a plurality of flat portions, the flat bottom surface refers to the longest flat portion in the direction of the ink channels 10. In the embodiments of the present invention, the first depth H1 corresponds to the depth of the deepest portion in the ink channel 10. The distance between the side walls means a distance measured at a height at which the groove depth is halved.

To the other end (rear end) of the actuator base plate 2 and the plate member 4, the manifold member 7 is bonded. In a part of the manifold member 7, an ink supply port 31 is formed for the supply of ink from an ink tank (not shown). The manifold member 7 forms a common ink chamber 9 communicating with all of the ink channels 10. When the ink channel 10 increases in capacity, the manifold member 7 feeds ink to the expanded ink channel 10.

In the foregoing constitution, the actions of the ink jet head will be described.

Figure 8A:
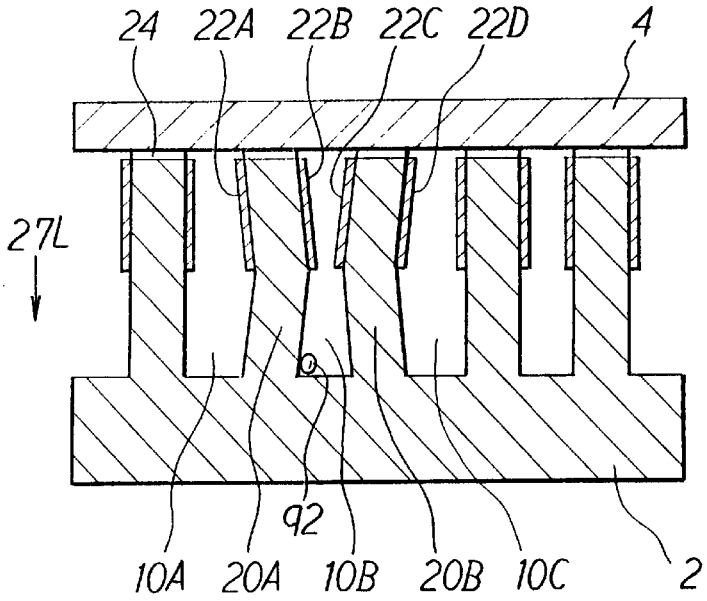
FIGS. 8A and 8B are explanatory cross sectional views showing the ink channels during the operation of the ink jet head.
Figure 8B:
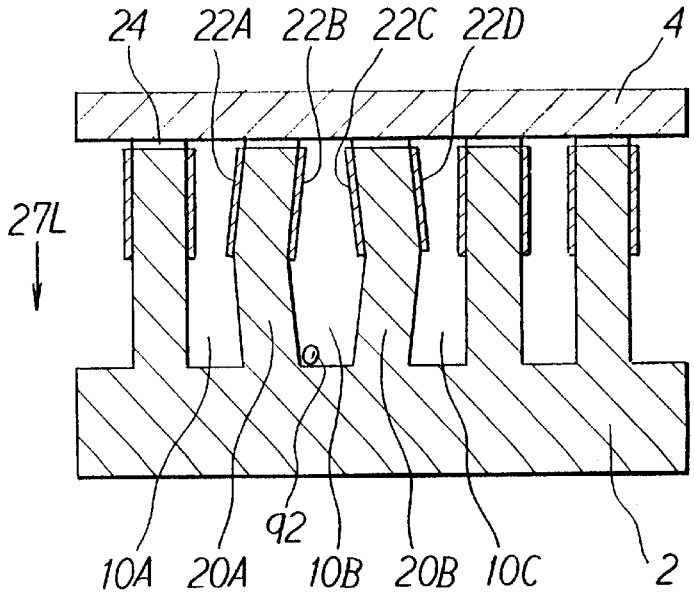

When the ink jet recorder is to perform printing, as shown in FIG. 8A, a specific ink channel 10B is selected in accordance with print data given. Electrodes 22B and 22C of the selected ink channel 10B are grounded, and a drive voltage is applied to electrodes 22A and 22D of ink channels 10A and 10C located on both sides of the ink channel 10B. Drive electric fields heading toward the ink channel 10B are generated in side walls 20A and 20B of the ink channel 10B, whereby the polarized side walls 20A and 20B bend toward each other because of a piezoelectric thickness shear effect. Since the ink channel 10B decreases in capacity owing to the bending of both side walls 20A and 20B, ink in the ink channel 10B is pressurized. As a result, the ink is ejected through the nozzle 30 as an ink droplet.

When the drive voltage is stopped afterwards, the side walls 20A and 20B return to their state before bending, whereupon the ink pressure in the ink channel 10B lowers. Thus, ink in the common ink chamber 9 is fed into the ink channel 10B to replenish ink in an amount corresponding to the amount of the ejected ink droplet and make the ink channel 10B ready for the next ejection of an ink droplet.

When the direction of polarization is reversed or the direction of the electric field is reversed, the side walls 20 can be deformed in a direction in which the ink channel 10 expands. This is another constitution that may be effected. As a result, ink is fed to the ink channel 10 from the common ink chamber 9. Then, the electric field applied to the side walls 20 is eliminated, whereupon the side walls return to their original straight form. By this return action, the ink in the ink channel 10 is pressurized, whereby an ink droplet is ejected through the nozzle 30. A plurality of methods for varying the capacity of the ink channel 10 may be combined to stabilize the ejection of an ink droplet or control the volume or the flying speed of an ink droplet.

During printing by the ejection of ink droplets in the above manner or after replacement of an ink cartridge (not shown) due to ink exhaustion, air bubble 92 may enter the ink channel 10. If this happens, even when the capacity of the ink channel 10 increases or decreases upon the bending of the side walls 20, the air bubbles 92 in the ink channel 10 expand or shrink, so that an appropriate ink pressure may not be obtained. Alternatively, growth of the air bubbles 92 may obstruct the ink channel 10 or the nozzle 30. In this case, a printing failure may occur. When the ink jet recorder undergoes this failure, a suction treatment is performed to remove the air bubbles 92 from the ink channel 10.

The suction treatment, although not shown but as already known, is to bring a cap into intimate contact with the front surface of the nozzle plate 6 while surrounding the nozzle 30, and suck ink in the ink channel 10 through the nozzle 30 via the cap by means of a pump. An alternative method (not shown) is to provide a pressurizing device on the ink tank side and force ink out of the ink channel 10 by its pressure. This method can also give a comparable effect, and it is included in the suction treatment in the present specification. The suction treatment performed once or a cycle of times sucks ink at a volume equal to or larger than the capacity of the ink channel 10 to discharge the air bubbles 92 in the ink channel 10 together with the ink. In the instant embodiment, the ratio of B, the distance between the side walls 20, to A, the height of the side wall 20 of the channel cross section, is set in the range of from about 0.5 to 2.0, as shown in FIGS. 2 and 3. Thus, a single suction treatment, for example, can remove 80% or more of the air bubbles 92. To increase the air bubble removal rate to 90% or more, the ratio B/A is preferably from 1.0 to 1.5.

If this ratio B/A is set at from about 0.5 to 2.0, most of the air bubbles 92 can be removed by a less frequent suction treatment. This fact was confirmed by the following experiments:

As shown in FIGS. 2 to 6, various ink jet heads were prepared in which the ratio of B, the distance between the side walls, to A, the height of the side wall of the channel cross section at the front end on the nozzle 30 side was from 0.25 to 2.5. FIG. 2 conceptually shows a state in which the ratio of B, the distance between the side walls, to A, the height of the side wall, was set at less than 1 so that the channel cross section would be vertically oblong. In this case, the air bubbles 92 tend to lie at the upper or lower end of the channel cross section, as illustrated in FIG. 3.

Figure 4:
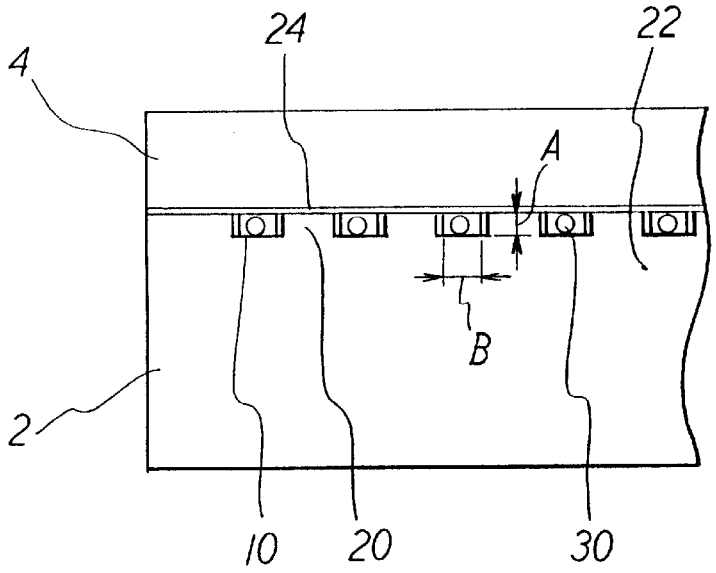
FIG. 4 is an explanatory cross sectional view showing ink channels of the ink jet head according to another embodiment of the invention.
Figure 5:
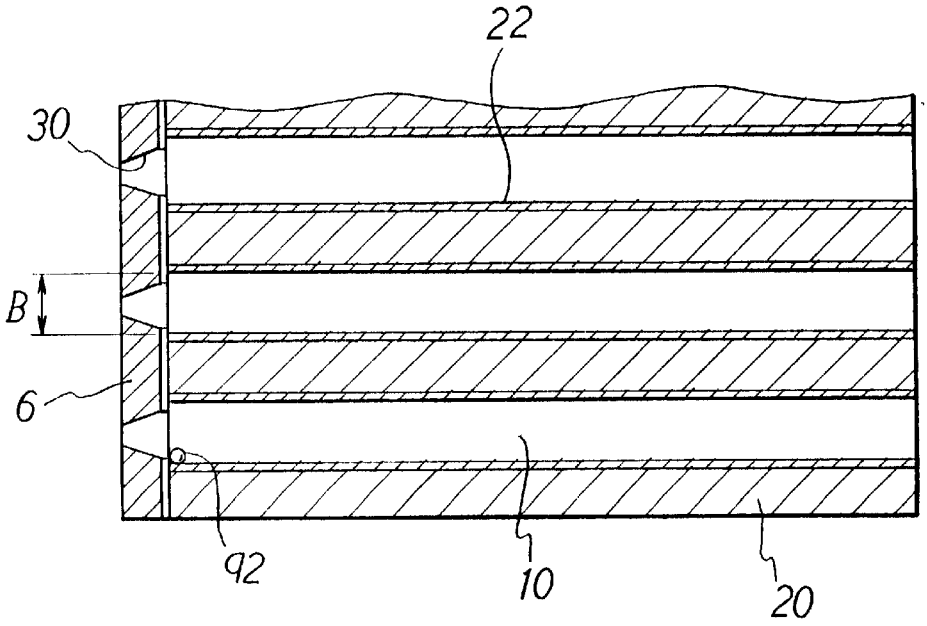
FIG. 5 is a transverse sectional view of the ink jet head shown in FIG. 4.
Figure 6:
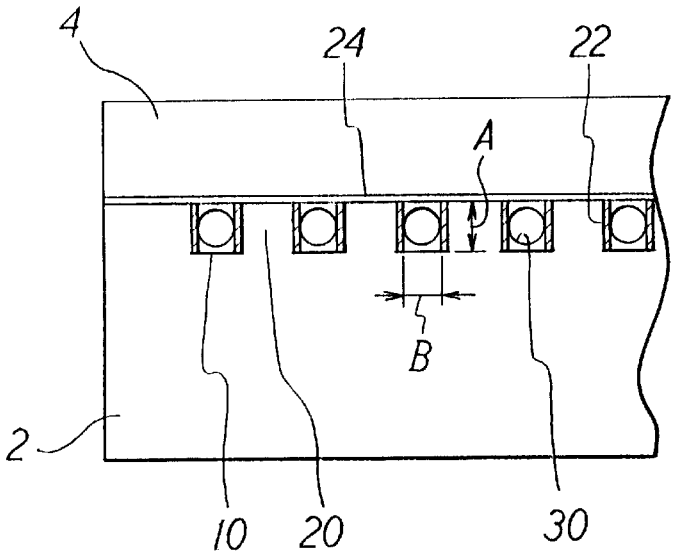
FIG. 6 is an explanatory cross sectional view showing ink channels of the ink jet head according to another embodiment of the invention.

FIG. 4 conceptually shows a state in which the ratio of B, the distance between the side walls, to A, the height of the side wall, was set at more than 1 so that the channel cross section would be horizontally oblong. In this case, the air bubbles 92 tend to dwell at the right or left end of the channel cross section, as illustrated in FIG. 5, a transverse sectional view taken from FIG. 4. FIG. 6 shows a state in which the ratio of B, the distance between the side walls, to A, the height of the side wall, was set at 1 so that the channel cross section would be square. In any of the cases shown in FIGS. 2, 4 and 6, H1, the height of the side wall at a rear site of the ink channel was constant.

Figure 7:
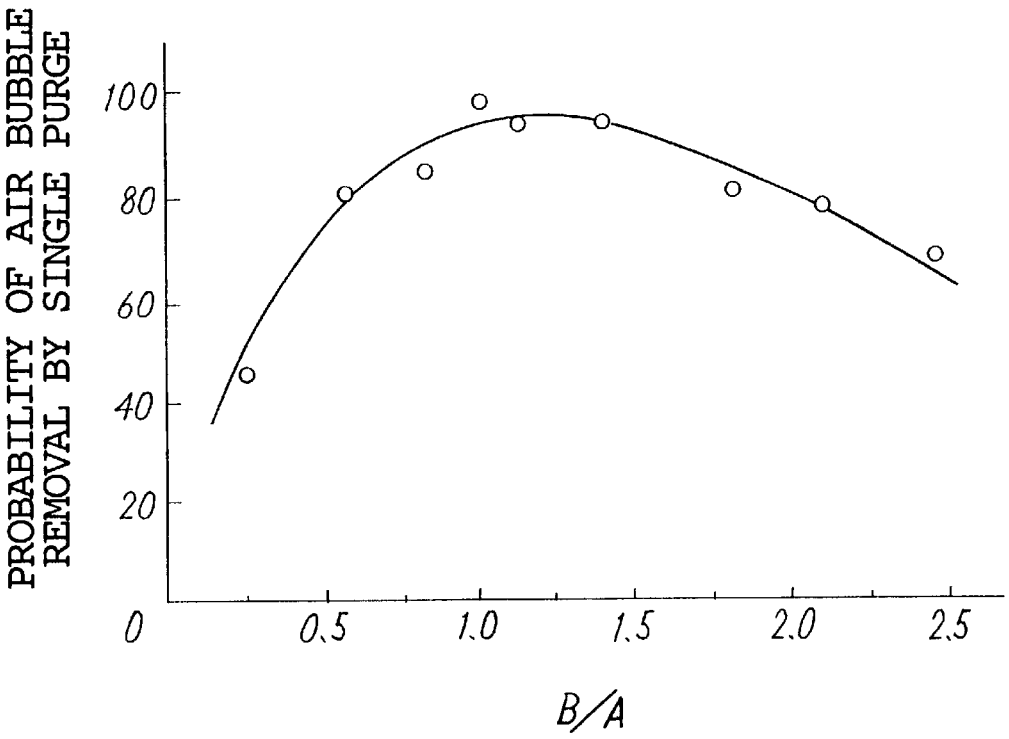
FIG. 7 is a graph showing the relationship between the ratio of the channel cross section (B/A) and the probability of air bubble removal.

As shown in FIGS. 3 and 5, a predetermined volume, based on each ink jet head, of the air bubbles 92 were caused to exist. Then, the aforementioned suction treatment was performed for each ink jet head, and the probability of the air bubbles 92 being removable by a single suction treatment was determined. As shown in FIG. 7, it was confirmed that when the ratio of B, the distance between the side walls, to A, the height of the side wall, was set at from about 0.5 to 2.0, about 80% or more of the air bubbles 92 could be removed by a single suction treatment. It is difficult to increase the removal rate of the air bubbles 92 to 100%. Since the frequency of air bubble penetration into the ink channel 10 is relatively low, the removal rate of 80% is acceptable for practical use.

On the other hand, if the ratio of the second depth H2 to the first depth H1 is set at from about 0.1 to 0.8, most of the air bubbles 92 can be removed by a less frequent suction treatment. This fact was confirmed by experiments described below. The first depth H1 is a constant depth which is selected in the range of 0.2 to 0.4 mm.

Figure 11:
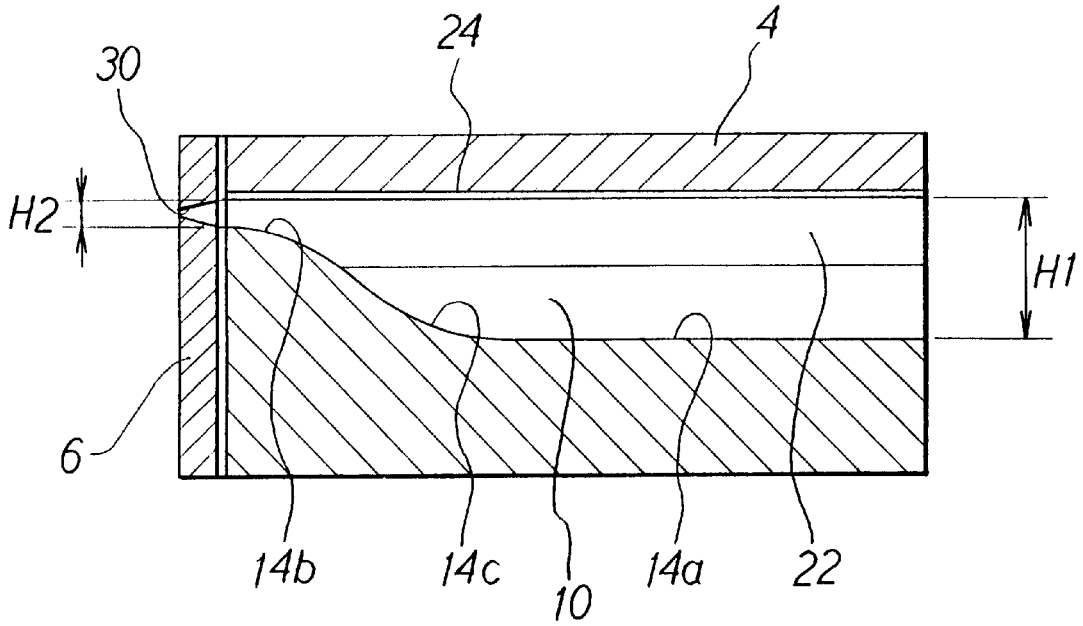
FIG. 11 is a longitudinal sectional view of the ink jet head of FIG. 3 with the H2/H1 varied.
Figure 12:
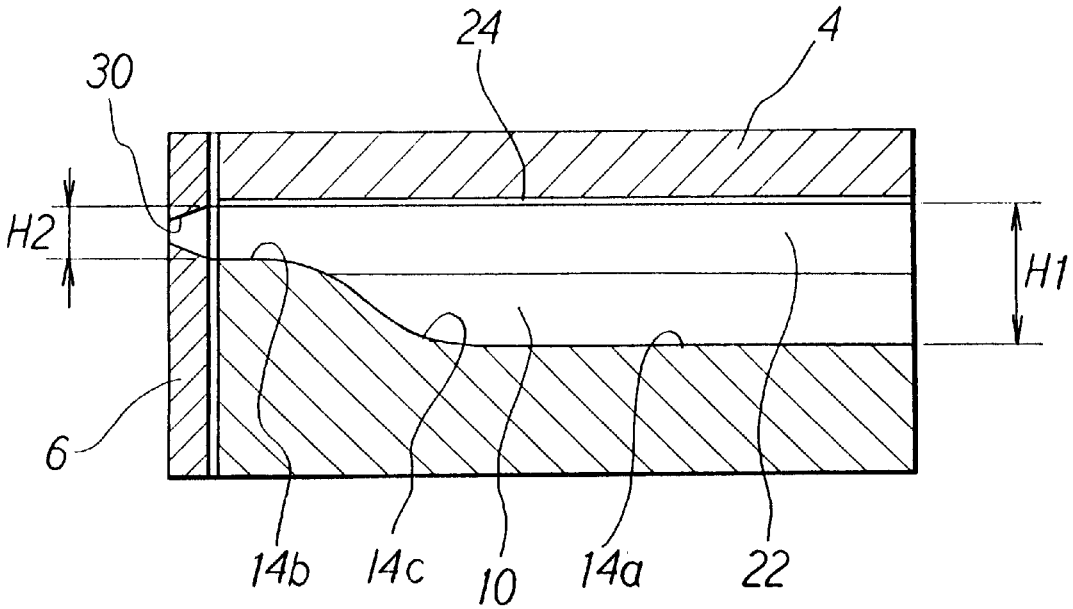
FIG. 12 is a longitudinal sectional view of the ink jet head of FIG. 11 with the H2/H1 varied.
Figure 13:
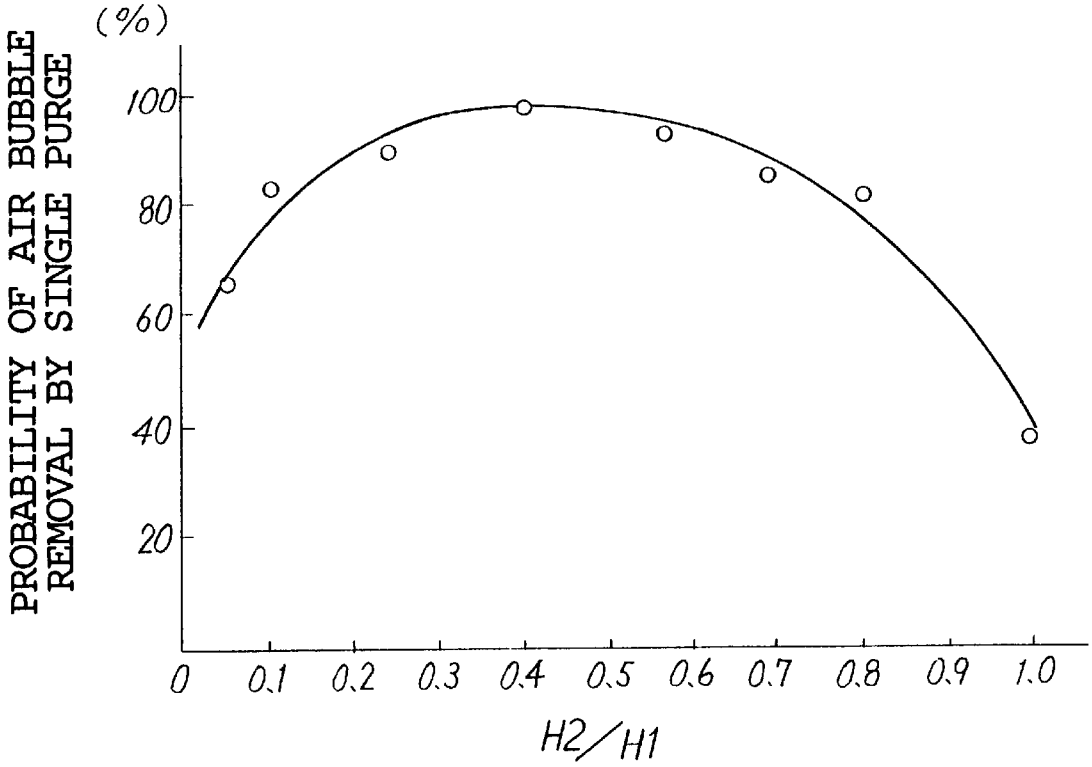
FIG. 13 is a graph showing the relationship between the depth ratio (H2/H1) and the probability of air bubble removal.
Figure 14:
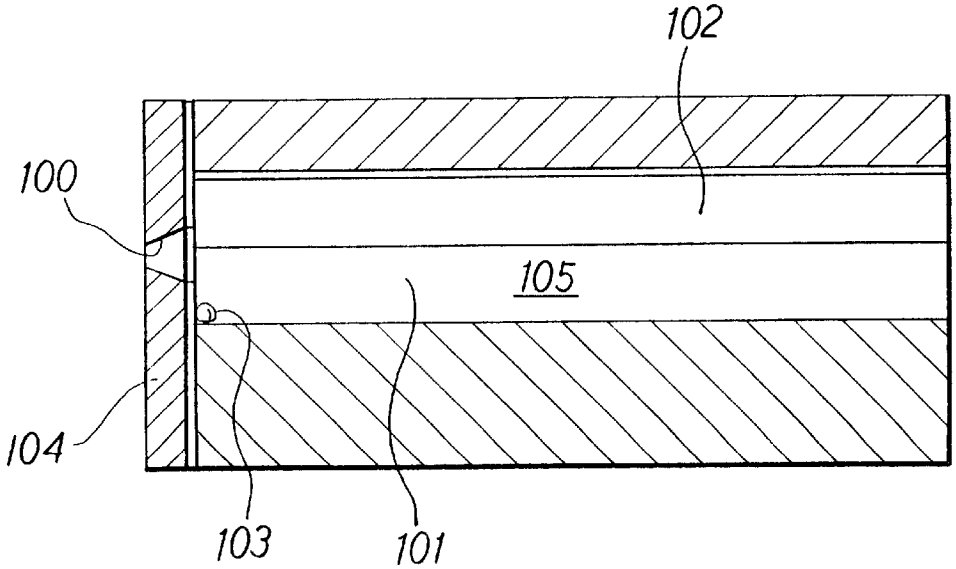
Fig. 14 PRIOR ART
FIG. 14 is a longitudinal sectional view of a conventional ink jet head.

As shown in FIGS. 3, 11 and 12, various ink jet heads were prepared in which the ratio of the second depth H2 to the first depth H1 was from 0.05 to 1.0. The position 14*c* at which the bottom surface of the ink groove 14 began to rise was made constant regardless of an increase or decrease in the H2/H1 ratio. A predetermined volume, based on each ink jet head, of the air bubbles 92 were caused to exist. Then, the aforementioned suction treatment was performed for each ink jet head, and the probability of the air bubbles 92 being removable by a single suction treatment was determined. As shown in FIG. 13, it was confirmed that when the ratio of the second depth H2 to the first depth H1 was set in the range of from 0.1 to 0.8, about 80% or more of the air bubbles 92 could be removed by a single suction treatment. To remove 90% or more of the air bubbles, the preferred H2/H1 ratio is from 0.2 to 0.6. It is difficult to increase the removal rate of the air bubbles 92 to 100%, and the frequency of air bubble penetration into the ink channel 10 is relatively low. Thus, the removal rate of 80% is acceptable for practical use.

As described above, according to the ink jet head of the instant embodiment, the nearly circular nozzle 30 with almost the largest diameter that can be set for the channel cross section of the ink channel 10 is provided at the front end of the ink channel 10, as shown in FIG. 1. By exerting pressure on ink in the ink channel 10, the ink is ejected through the nozzle 30. The ink channel 10 is formed so as to have the first depth H1 at a planner portion apart from the nozzle 30 and the second depth H2 at a portion connected to the nozzle 30, with the ratio of the second depth H2 to the first depth H1 being set in the range of from 0.1 to 0.8. By so setting this H2/H1 ratio at from 0.1 to 0.8, most of air bubbles 92 present in the ink channel 10 can be removed through the nozzle 30 by a suction treatment performed with a decreased frequency.

According to the ink jet head of the instant embodiment described above, the nearly circular nozzle 30 with almost the largest diameter that can be set for the channel cross section of the ink channel 10 is provided at the front end of the ink channel 10, as shown in FIG. 1. By exerting pressure on ink in the ink channel 10 upon bending of the side walls 20, the ink is ejected through the nozzle 30. The ratio of B, the distance between the side walls, to A, the height of the side wall of the ink channel 10, is set in the range of from about 0.5 to 2.0. In this embodiment, pressure is exerted on ink by bending the polarized side walls 20 upon application of an electric field. However, this is not restrictive, and it is permissible to heat ink to produce a bubble, and exert pressure by the expansion pressure of this bubble. Alternatively, it is allowable to provide a vibrating plate along the ink channel 10, and vibrate this vibrating plate by a piezoelectric element or other means to apply pressure.

The above constitution which sets the ratio of B, the distance between the side walls, to A, the height of the side wall, in the range of from about 0.5 to 2.0 enables most air bubbles 92 present in the ink channel 10 to be removed through the nozzle 30 by a less frequently performed suction treatment.

The instant embodiment is also constituted such that the nozzle plate 6 having the nozzles 30 is bonded to the end surface on the front side of the actuator base plate 2 having the ink channels 10. Thus, the air bubbles 92 lying at the corner formed by the surroundings of the nozzle 30 of the nozzle plate 6 and the front end of the ink channel 10 can be removed easily by a suction treatment.

The ink channel 10 in this embodiment is constituted such that the cross sectional area of the channel cross section at the site of connection with the nozzle plate 6 is set to be smaller than the cross sectional area of the channel cross section at a site apart from the nozzle 30, and the electrode 22 is formed over nearly the entire length of the wall surface of the side wall 20 so as to exert pressure on ink at the site apart from the nozzle 30. As noted from this, pressure is exerted on ink mainly in a portion with a large cross sectional area apart from the nozzle 30. Consequently, ink can be ejected at a sufficiently high pressure, even when the cross sectional area of the channel cross section is decreased at a site near the nozzle 30.

In the instant embodiment, the distance between the side walls of the ink channel 10 is set to be constant in the region ranging from the front end to the rear end of the ink channel 10. However, the side walls 20 of the ink channel 10 may be deformed in a direction in which they change the cross sectional area of the ink channel 10, whereby pressure may be exerted on ink. In this case, even when the cross sectional area of the channel cross section is decreased at a site near the nozzle 30, a high pressure can be exercised on ink by the deformation of the side walls 20. Thus, efficient ejection of ink can be performed.

Figure 9:
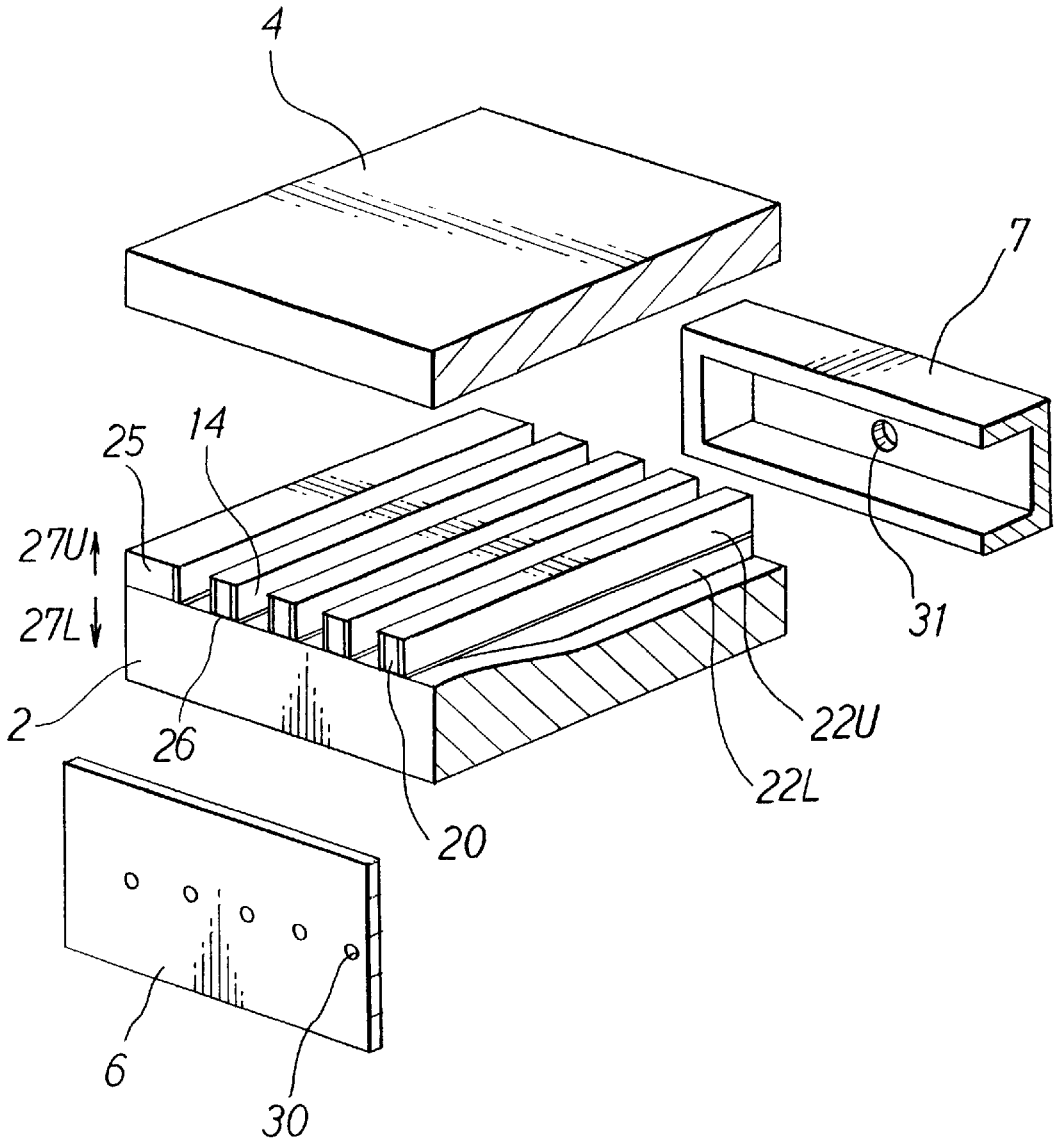
FIG. 9 is an exploded perspective view of an ink jet head according another embodiment of the invention.

This embodiment has been described using the ink jet head in which the side walls 20 defining the ink channel 10 are polarized in only one direction 27L. However, this is not restrictive. That is, as illustrated in FIG. 9, the ink jet head may be constituted in the following manner: To an actuator base plate 2 polarized in the direction 27L, a piezoelectric member 25 polarized in the opposite direction 27U is bonded via an adhesive layer 26. Then, the piezoelectric member 25 and the actuator base plate 2 are cut to form ink grooves 14, and electrodes 22L, 22U are formed on a side wall 20 having a two-layer structure. Because of this constitution, the ink groove 14 demarcated by the side walls 20 can be deformed at a half voltage.

Figure 10:
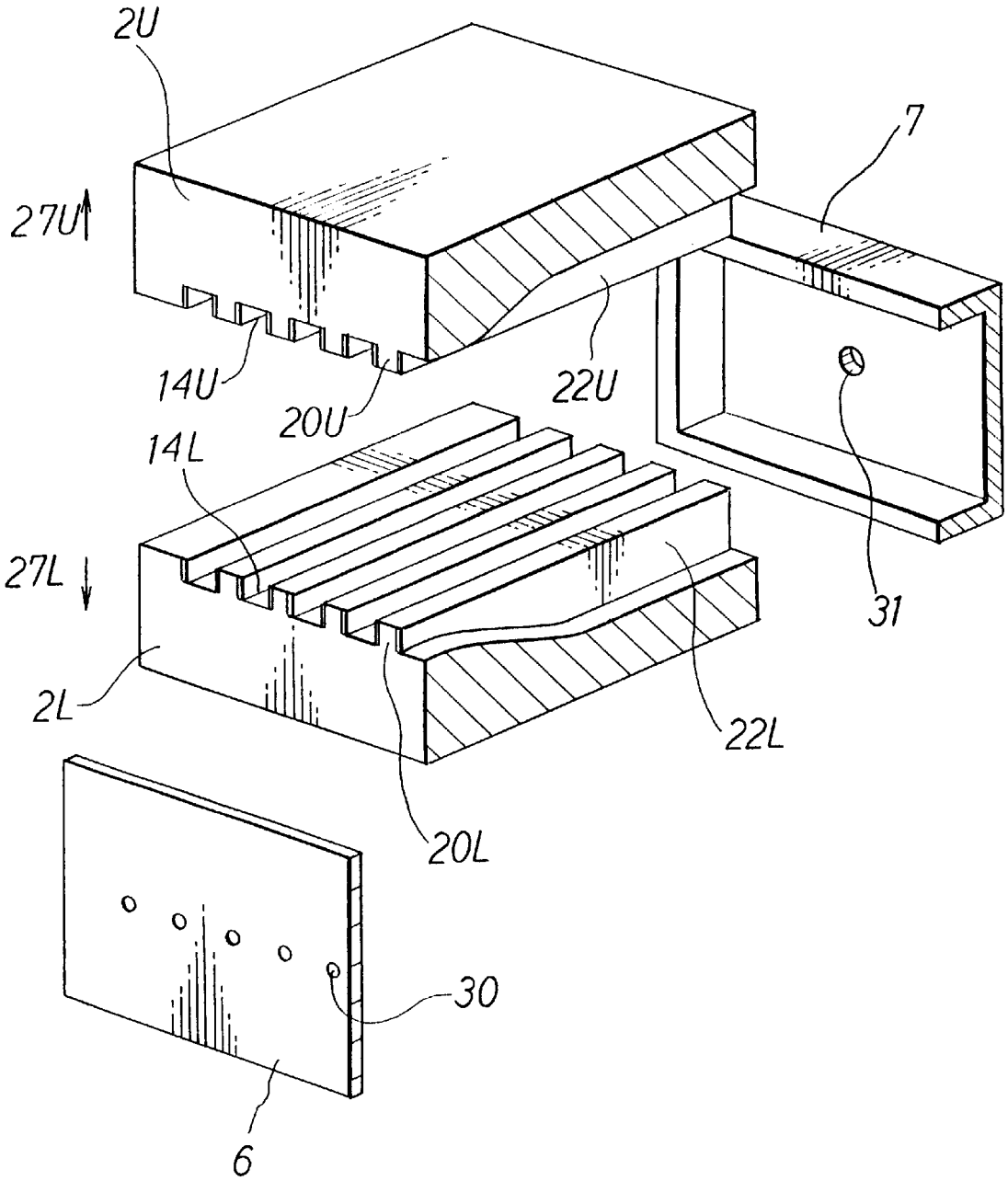
FIG. 10 is an exploded perspective view of an ink jet head according another embodiment of the invention.

The ink jet head, as shown in FIG. 10, may be constituted as follows: Actuator base plates 2U, 2L having electrodes 22U, 22L formed on side walls 20U, 20L of ink grooves 14U, 14L are bonded together to be paired up vertically. As a result, the side walls 20U, 20L are provided which are polarized in one direction 27U and the other direction 27L. The ink jet head may also be constituted such that between the adjacent ink channels 10, there is a space which does not accommodate ink and which does not eject ink droplets.

In the embodiment, all grooves (channels) have been filled with ink, but there may be a structure in which each ink channel is sandwiched between blank grooves. Preferably, the sectional shape of the nozzle 30 formed in the nozzle plate 6 is such a shape as to connect smoothly with the sectional shape of the front end portion of the ink channel 10. The bottom surface of the ink channel may be curved.

The ink jet head of the present invention that has been concretely described is useful for an ink jet recorder such as ink jet printer and facsimile. The ink jet printer usually has the ink jet head, an ink supply device such as an ink cartridge for feeding ink to the ink jet head, and a carriage for holding the ink jet head and moving it along and over a recording medium such as printing paper. Thereby, the ink jet printer ejects the ink from the ink jet head onto a certain printing place on the recording medium. The structure of an ink jet printer is disclosed, for example, in U.S. Pat. No. 5,639,220, the disclosure of which is incorporated herein by reference. An ink jet recorder using the ink jet head of the present invention can reliably discharge air bubbles building up in the ink head by a purge (ink suction) treatment performed a decreased number of times. Thus, recording can be carried out rapidly, electric power for purging can be decreased, and high grade printing can be ensured.

What is claimed is:

1. An ink jet head, comprising:

at least one nozzle formed at one end of the ink jet head; and at least one ink channel formed inside the ink jet head so as to connect with the at least one nozzle, an ink channel connected to a nozzle; wherein the at least one ink channel is formed so as to have a flat bottom surface at a portion apart from a portion connected to the at least one nozzle and such that a ratio H2/H1 of a depth H2 of the at least one ink channel at the portion connected to the at least one nozzle to a depth H1 of the at least one ink channel having the flat bottom surface is in a range of from 0.1 to 0.8.

2. The ink jet head as claimed in claim 1, including:

a head body having the at least one ink channel formed so as to pass through the inside of the head body, and a nozzle plate having the at least one nozzle formed therein; wherein the nozzle plate is secured to the head body such that the at least one nozzle is connected to one open end of the head body formed by the at least one ink channel passing through the inside of the head body.

3. The ink jet head as claimed in claim 2, wherein the at least one ink channel passes straight through the head body.

4. The ink jet head as claimed in claim 2, wherein the depth H2 is the depth of the at least one ink channel at the one open end, while the depth H1 is the depth of the at least one ink channel at another open end, and the depth of the ink channel gradually decreases, beginning at an ink channel portion having the flat bottom surface and ending at the portion connected to the at least one nozzle.

5. The ink jet head as claimed in claim 1, wherein the at least one ink channel is formed such that the ratio H2/H1 of the depth H2 to the depth H1 is in the range of from 0.2 to 0.6.

6. The ink jet head as claimed in claim 1, having a plurality of side walls wherein each of the side walls of the at least one ink channel can be deformed so as to vary the cross-sectional area of the at least one ink channel, whereby ink in the at least one ink channel is ejected through the at least one nozzle.

7. The ink jet head as claimed in claim 6, wherein the side wall of the at least one ink channel is composed of a piezoelectric material, and a drive electrode for deforming the piezoelectric material is provided on the side wall.

8. The ink jet head as claimed in claim 6, wherein the side wall of the at least one ink channel is composed of an upper portion and a lower portion, and the upper portion and the lower portion are made of piezoelectric materials polarized in different directions of polarization.

9. The ink jet head as claimed in claim 1, wherein a ratio of a distance between side walls of the at least one ink channel to a height of the side walls of the at least one ink channel at a portion connected to the at least one nozzle is in a range of from 0.5 to 2.0.

10. An ink jet head, comprising:

at least one nozzle formed at one end of the ink jet head; and at least one ink channel formed inside the ink jet head so as to connect with the at least one nozzle, an ink channel connected to a nozzle, wherein a ratio of a distance between side walls of the at least one ink channel to a height of the side walls of the at least one ink channel at a portion connected to the at least one nozzle is in a range of from 0.5 to 2.0; and wherein a cross sectional area of the at least one ink channel is larger at an inward site of the head than at a site of connection with the at least one nozzle.

11. The inkjet head as claimed in claim 10, including:

a head body having the at least one ink channel formed so as to pass through the inside of the head body, and a nozzle plate having at least one nozzle formed therein; wherein the nozzle plate is secured to the head body such that the at least one nozzle is connected to one open end of the head body formed by the at least one ink channel passing through the inside of the head body.

12. The ink jet head as claimed in claim 11, wherein the at least one ink channel passes straight through the head body.

13. The ink jet head as claimed in claim 11, wherein the at least one ink channel is formed so as to have a flat bottom surface at a portion apart from the portion connected to the at least one nozzle and such that a ratio H2/H1 of a depth H2 of the at least one ink channel at the portion connected to the at least one nozzle to the depth H1 of the at least one ink channel having the flat bottom surface is in a range of from 0.1 to 0.8.

14. The ink jet head as claimed in claim 13, wherein the at least one ink channel is formed such that the ratio H2/H1 of the depth H2 to the depth H1 is in the range of from 0.2 to 0.6.

15. The ink jet head as claimed in claim 10, wherein the side walls of the ink channel can be deformed so as to vary a cross-sectional area of the at least one ink channel, whereby ink in the at least one ink channel is ejected through the at least one nozzle.

16. The ink jet head as claimed in claim 15, wherein the side walls of the at least one ink channel are composed of a piezoelectric material, and a drive electrode for deforming each piezoelectric material is provided on the side wall.

17. The ink jet head as claimed in claim 15, wherein the side walls of the at least one ink channel are composed of an upper portion and a lower portion, and the upper portion and the lower portion are made of piezoelectric materials polarized in different directions of polarization.

18. An ink jet recorder, comprising:

an ink jet head having at least one nozzle formed at one end of the ink jet head, and at least one ink channel formed inside the ink jet head so as to connect with the at least one nozzle; and an ink supply device for supplying ink to the ink jet head, wherein the at least one ink channel is formed so as to have a flat bottom surface at a portion apart from a portion connected to the at least one nozzle and such that a ratio H2/H1 of a depth H2 of the at least one ink channel at the portion connected to the at least one nozzle to a depth H1 of the at least one ink channel having the flat bottom surface is in a range of from 0.1 to 0.8.

19. An ink jet recorder, comprising:

an ink jet head having at least one nozzle formed at one end of the ink jet head, and at least one ink channel formed inside the ink jet head so as to connect with the at least one nozzle; and an ink supply device for supplying ink to the ink jet head, wherein a ratio of a distance between side walls of the at least one ink channel to a height of the side walls of the at least one ink channel at a portion connected to the at least one nozzle is in a range of from 0.5 to 2.0; and wherein a cross sectional area of the at least one ink channel is larger at an inward site of the head than at a site of connection with the at least one nozzle.

20. The ink jet recorder as claimed in claim 19, wherein the at least one ink channel is formed so as to have a flat bottom surface at a portion apart from a portion connected to the at least one nozzle and such that a ratio H2/H1 of a depth H2 of the at least one ink channel at the portion connected to the at least one nozzle to a depth H1 of the at least one ink channel having the flat bottom surface is in a range of from 0.1 to 0.8.

* * * * *